US007074315B2

(12) United States Patent
Desmaison et al.

(10) Patent No.: US 7,074,315 B2
(45) Date of Patent: Jul. 11, 2006

(54) COPPER BATH AND METHODS OF DEPOSITING A MATT COPPER COATING

(75) Inventors: Gonzalo Urrutia Desmaison, Berlin (DE); Stefan Kretschmer, Berlin (DE); Gerd Senge, Berlin (DE); Thorsten Ross, Berlin (DE); Torsten Küssner, Berlin (DE)

(73) Assignee: Atotech Deutschland GmbH, Berlin (DE)

( * ) Notice: Subject to any disclaimer, the term of this patent is extended or adjusted under 35 U.S.C. 154(b) by 94 days.

(21) Appl. No.: 10/398,635

(22) PCT Filed: Oct. 10, 2001

(86) PCT No.: PCT/EP01/11734

§ 371 (c)(1),
(2), (4) Date: Apr. 7, 2003

(87) PCT Pub. No.: WO02/33153

PCT Pub. Date: Apr. 25, 2002

(65) Prior Publication Data

US 2004/0020783 A1 Feb. 5, 2004

(30) Foreign Application Priority Data

Oct. 19, 2000 (DE) ..... 100 52 987
Nov. 22, 2000 (DE) ..... 100 58 896

(51) Int. Cl.
*C25D 3/38* (2006.01)
*C23C 18/00* (2006.01)

(52) U.S. Cl. ..... 205/296; 106/1.26

(58) Field of Classification Search ..... 106/1.26; 205/296

See application file for complete search history.

(56) References Cited

U.S. PATENT DOCUMENTS

| | | | | |
|---|---|---|---|---|
| 3,682,788 | A | 8/1972 | Kardos et al. | 204/52 R |
| 3,945,894 | A | 3/1976 | Martin et al. | 204/55 R |
| 4,134,803 | A | 1/1979 | Eckles et al. | 204/52 R |
| 4,336,114 | A | 6/1982 | Mayer et al. | 204/52 R |
| 4,376,685 | A | 3/1983 | Watson | 204/52 R |
| 4,385,967 | A | 5/1983 | Brady et al. | 204/27 |
| 4,555,315 | A | 11/1985 | Barbieri et al. | 204/52 R |
| 4,755,271 | A | 7/1988 | Hosten | 204/198 |

(Continued)

FOREIGN PATENT DOCUMENTS

DE 25 17 701 12/1976

(Continued)

OTHER PUBLICATIONS

"Handbuchder Leiterplattentechnik", vol. 3, Leuze-Verlag, Saulgau, p. 480, no date.

(Continued)

*Primary Examiner*—Edna Wong
(74) *Attorney, Agent, or Firm*—Frank J. Bonini, Jr.; John F. A. Earley, III; Harding, Earley, Follmer & Frailey

(57) ABSTRACT

In the production of printed circuit boards it is required that organic protective coatings adhere tightly on the copper surfaces. Accordingly, matt layers of copper are to be preferred over lustrous coatings. The bath in accordance with the invention serves to deposit matt layers of copper and has the additional advantageous property that the layers may also be deposited with sufficient coating thickness in very narrow bore holes at average cathode current density. For this purpose the bath contains at least one polyglycerin compound selected from the group comprising poly(1,2,3-propantriol), poly(2,3-epoxy-1-propanol) and derivatives thereof.

29 Claims, 2 Drawing Sheets

U.S. PATENT DOCUMENTS

| | | | | |
|---|---|---|---|---|
| 4,776,939 | A | 10/1988 | Blasing et al. | 204/202 |
| 4,781,801 | A | 11/1988 | Frisby | 204/25 |
| 4,975,159 | A | 12/1990 | Dahms | 204/15 |
| 5,328,589 | A | 7/1994 | Martin | 205/296 |
| 5,433,840 | A | 7/1995 | Dahms et al. | 205/296 |

FOREIGN PATENT DOCUMENTS

| | | |
|---|---|---|
| DE | 32 36 545 | 1/1987 |
| DE | 36 24 481 | 8/1993 |
| EP | 0 137 397 | 4/1985 |
| EP | 0 254 962 | 7/1988 |
| JP | 49028571 | 7/1974 |
| JP | 49028571 B4 * | 7/1974 |
| JP | 2000-192279 A2 * | 7/2000 |
| SU | 1158621 | 5/1985 |

OTHER PUBLICATIONS

"Die Nahrung", Behrens, Mieth, 28, (1984), p. 816, p. 821, no month.

Cosmet.Sci. Technol.Ser. Glycerines,p. 106 (1991), no month.

Chemical Abstracts 82: 112816, no date.

* cited by examiner

COPPER BATH AND METHODS OF DEPOSITING A MATT COPPER COATING

The invention relates to an electrolytic copper plating bath and to a method of depositing a copper coating onto a substrate, more specifically onto the surface of a printed circuit board.

Layers of copper are deposited onto bases that mostly have good electrical conducting properties to serve multiple purposes. Layers of copper serve for example to produce decorative coatings on parts of plastic and metal. In this application, the layers of copper are usually coated with layers of other metals such as nickel and chromium. Layers of copper are moreover applied onto substrates to perform functions. An example thereof is the production of printed circuit boards. To create conductors lines and lands on the surfaces of printed circuit boards as well as electrically conductive layers on the walls of bore holes in the printed circuit board, copper is plated over the surface of the board including the bore hole walls because it has a very good electrically conducting property and can be readily deposited in a state of high purity.

In printed circuit board technique, copper layers usually produced are lustrous. These layers have to meet various requirements, including very good mechanical properties, more specifically high breaking elongation and high tensile strength. The layers produced must moreover have as far as possible the same thickness at all places on the printed circuit board material. More specifically in fine holes, current density is to depart only a little from current density on the outer sides of the printed circuit boards, in spite of the small density of electric field lines prevailing in the holes. In addition, the properties mentioned are also to be achievable in particular when a high cathode current density is applied in order to permit deposition of as thick a copper layer as possible within a short treatment time. Electroless copper deposition does not provide electrical conductivity for PCT interconnects as required.

Copper plating baths have been described in U.S. Pat. Nos. 3,682,788; 4,376,685; 4,134,803; 4,336,114; 4,555,315; 4,781,801; 4,975,159; 5,328,589 and 5,433,840. Stated in general terms, the baths in question usually are compositions containing copper sulfate and sulfuric acid as well as small quantities of chloride. The compositions indicated therein serve to deposit bright coatings and are substantially suited to form layers with good mechanical properties. Furthermore, the layers of copper produced with these baths are to have substantially a uniform thickness at all places of a substrate formed into a complex shape.

To produce conductor lines and other structures such as lands and after formation of said structures, produced layers of copper are generally coated by means of organic protective coatings that either serve to protect the underlying layer of copper against an etchant used to establish the structure or to prevent fluid solder from contacting the copper surfaces during the process of soldering. The organic protective coatings customarily employed are layers of photoresist.

Organic protective coatings must be bonded tightly onto the copper surfaces. For this purpose, the bright copper layers are cleaned at first, fat and dust impurities as well as oxide films being removed in the process. The layer of copper should moreover be provided with a certain roughness and structure because only surfaces with a sufficient profiling depth allow organic layers to better bond with the surface than smooth and bright surfaces (Handbuch der Leiterplattentechnik [Manual of the printed circuit board technique], vol. 3, Eugen G. Leuze-Verlag, Saulgau, page 480). Accordingly, resist layers cannot be applied direct onto copper surfaces, these have to be roughened beforehand.

In Chemical Abstracts 82:112816 referring to JP 49028571 A an electroless copper plating bath is disclosed the bath containing a copper salt, a reducing agent, a complexing agent, a pH adjusting agent and 0.005–5 g/l of a compound selected from the group comprising polyglycerin or esters thereof or sorbitan esters, which prolong the lifetime of the bath and prevent deposition of impurities on the plated surfaces. This type of bath may deposit $\leqq 1$ μm thick copper layers and may thus provide the basis for electroplating.

An acid electroplating copper bath for depositing fine grained ductile copper has been suggested in EP 0 137 397 A2, said bath containing polymers from bifunctional derivatives of propane that are polymerized in the presence of 1 to 50 mol-% of one or several unsaturated alcohols with 3 to 10 carbon atoms and one or several double and/or triple bonds. Bifunctional derivatives of propane of choice are more specifically monochlorohydrin, epichlorohydrin and glycidol. According to the examples in this document and to produce the polymers added to the baths, epichlorohydrin, monochlorohydrin and glycidol are respectively copolymerized with butine-1,4-diol, 3-methyl-1-pentine-3-ol, hexine-3-diol-2,5 and 2,4,7,9-tetramethyl-5-decine-4,7-diol respectively. By adding these substances to a copper bath containing cupric sulfate and sulfuric acid as well as small concentrations of chloride ions, microcrystalline, ductile copper deposits are disclosed to be obtained and to have high values of breaking elongation and better behavior in shock testing than those obtained with heretofore known baths. Utilizing these baths additionally improves throwing power. Cathode current density that can be applied in principle ranges from 0.5 to 10 A/dm$^2$. According to the unique example in this document, a coating thickness of 90% in bore holes having a diameter of 0.3 mm referred to the coating thickness on the surfaces of the boards is obtained when the cathode current density employed amounts to 0.5 to 1.0 A/dm$^2$. Such lower current density presents a disadvantage in PCB production.

It has however proven that, on increasing cathode current density in excess of the value indicated in the example in EP 0 137 397 A2, throwing power of the bath is considerably reduced. Therefore, when printed circuit boards with extremely small diameters such as $d \leqq 0.3$ mm are to be produced, cathode current density is to be set to a maximum value of 1 A/dm$^2$. A higher cathode current density cannot be supported. On setting cathode current density to such a small value, small productiveness of the method is achieved, though.

The main object of the present invention is therefore to find an electrolytic copper plating bath and a method of depositing a copper coating onto a substrate, more specifically onto the surface of a printed circuit board, the method permiting to deposit within a short time layers of copper of very uniform coating thickness even in bore holes with a small diameter.

A further object of the present invention is to provide an electrolytic copper plating bath and a method of electroplating a copper layer, the copper layer having good mechanical properties like for example high breaking elongation and high tensile strength.

Yet another object of the present invention is to provide an electrolytic copper plating bath and a method of electroplating a copper layer that may be coated with organic coatings, more specifically with a photoresist, which may be bonded tightly onto said copper layer without additional roughening.

BRIEF DESCRIPTION OF THE DRAWING FIGURES

DETAILED DESCRIPTION OF THE PREFERRED EMBODIMENTS

Figure 1:
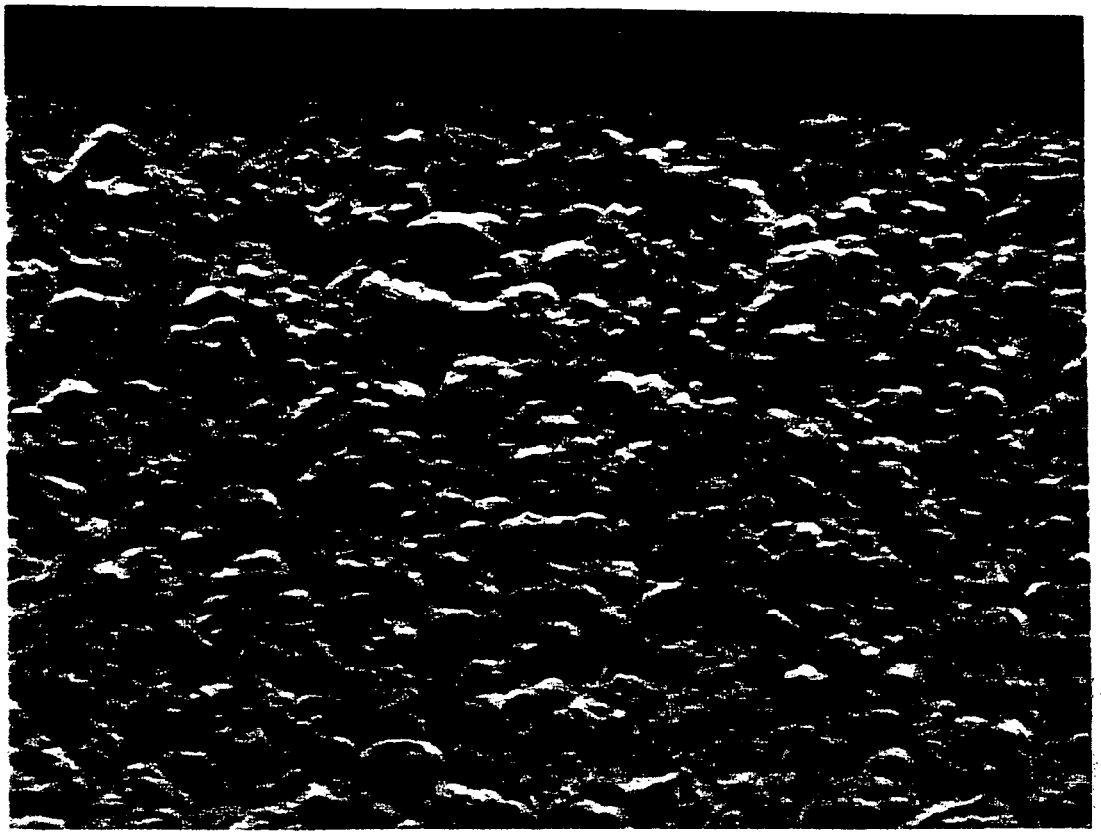
FIG. 1 is an electron micrograph showing a map of the coating surface obtained by means of a scanning electron microscope at a magnification of x1000.

The electrolytic copper plating bath according to the present invention is suitable for producing matt layers of copper and the method serves to electrodeposit a matt layer of copper on the surface of a work piece. The electrolytic copper plating bath according to the invention comprises at least one polyglycerin compound selected from the group comprising poly(1,2,3-propantriol), poly(2,3-epoxy-1-propanol) and derivatives thereof.

The method comprises the following method steps:

a. providing the work piece, at least one anode and a copper plating bath;
b. contacting the surface of the work piece and the at least one anode, respectively, with the copper bath, the copper bath comprising at least one polyglycerin compound selected from the group comprising poly(1,2,3-propantriol), poly(2,3-epoxy-1-propanol) and derivatives thereof; and
c. applying an electric voltage between the surface of the work piece and the at least one anode in such a manner that cathodic polarity is imposed upon the work piece relative to the at least one anode.

The copper plating bath and the method according to the present invention are more specifically employed to deposit layers of copper in the process of producing printed circuit boards. It is in principle also conceivable to utilize the bath and the method to produce layers that are applied on surfaces for other functional or decorative purposes such as for example for use in sanitary ware, in producing furniture fittings, lamps and other parts pertaining to the living area, fashion accessories and in the automotive industry as well. As a matter of fact, the bath and the method according to the present invention are not only suited to produce matt layers that are exclusively deposited on surfaces for functional purposes but also to produce matt layers intended to achieve decorative effects since the layers created with the bath and the method are very evenly matt so that appealing aesthetic effects may be achieved.

The copper plating bath and the method according to the present invention are more specifically utilized to produce layers of copper in producing printed circuit boards. Since the deposited layers are matt, organic coatings may be bonded tightly directly onto said layers. Therefore the present invention also relates to an electrolytic copper plating bath and to a method that further comprise forming an organic coating on the matt copper layer on the surface of the work piece. The organic coating may for example be a photoresist layer. More specifically, a photostructural solder resist mask may be deposited onto the matt layers of copper, without having to roughen said layers of copper beforehand. If need be, the copper surfaces only need to be cleaned to remove impurities such as fats, dust and oxide films.

The electrolytic copper plating bath according to the present invention contains at least one linear polyglycerin compound having general formula I

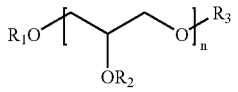

(I)

wherein n is an integer >1, preferably >2; and $R_1$, $R_2$ and $R_3$ are identical or different and are selected from the group comprising H, alkyl, acyl, phenyl and benzyl, wherein alkyl preferably is linear or branched $C_1$–$C_{18}$ alkyl and/or acyl preferably is $R_5$—CO, wherein $R_5$ is linear or branched $C_1$–$C_{18}$ alkyl, phenyl or benzyl; alkyl, phenyl and benzyl in formula I may be substituted.

The linear polyglycerin compounds represented with formula I are preferably employed. In principle, the bath may also contain other polyglycerin compounds, more specifically branched polyglycerin compounds, most preferably having α-β-branching according to general formula II

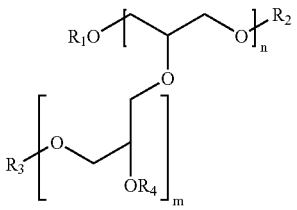

(II)

wherein n is an integer >0;

m is an integer >0; and $R_1$, $R_2$, $R_3$, $R_4$ are identical or different and are selected from the group comprising H, alkyl, acyl, phenyl and benzyl, wherein alkyl preferably is linear or branched $C_1$–$C_{18}$ alkyl and/or acyl preferably is $R_5$—CO, wherein $R_5$ is linear or branched $C_1$–$C_{18}$ alkyl; phenyl and benzyl may be substituted.

The bath may also contain other polyglycerin compounds, preferably having cyclic ether moieties, the compounds having general formula III:

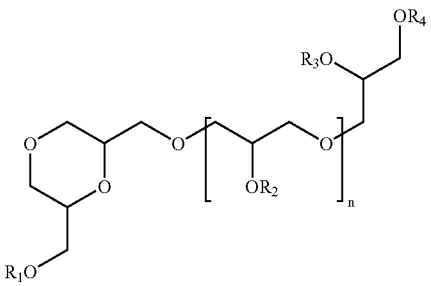

(III)

wherein n is an integer >0; and $R_1$, $R_2$, $R_3$, $R_4$are identical or different and are selected from the group comprising H, alkyl, acyl, phenyl and benzyl, wherein alkyl preferably is linear or branched $C_1$–$C_{18}$ alkyl and/or acyl preferably is $R_5$—CO, wherein $R_5$ is linear or branched $C_1$–$C_{18}$ alkyl, phenyl or benzyl; phenyl and benzyl may be substituted.

Formulae I, II and III indicated herein above comprise unsubstituted polyglycerine compounds as well as their derivatives, viz. derivatives with alkyl-, phenyl- and/or benzyl-substituted end groups, derivatives with alkyl-, phenyl- and/or benzyl-substituted alcohol groups as well as derivatives with end groups and derivatives, the alcohol groups being substituted with carboxylic acids.

As contrasted with the copolymers described in EP 0 137 793 A2, the polyglycerin compounds represented herein above are homopolymers.

The electrolytic copper plating bath and the method according to the present invention have the following advantages over known baths and methods:

a) the bath and the method permit to deposit very level layers of copper, even at a high cathode current density of, e.g. >2.5 A/dm$^2$. If printed circuit boards to be produced have bore holes with a very small diameter of e.g. 0.3 mm or less, the electric field intensity in the bore holes is much smaller than on the surface of the printed circuit boards. As a result thereof, cathode current density in the bore holes would normally be very small as compared to current density on the surface of the printed circuit boards. This difference may be partially compensated for by controlling overvoltage in the process of copper deposition.

This is the reason why, with known baths and methods using a small average current density (overall current/overall surface of the board including the faces of the bore hole walls) ranging e.g. up to 1 A/dm$^2$, the current density on the bore hole walls is observed to be reduced by 10% maximum referred to the current density on the surfaces of the boards. EP 0 137 397 A2 for example indicates in this regard that a throwing power of copper of >90% referred to conductors lines on the outer sides may be achieved when the cathode current density amounts to 0.5 to 1.0 A/dm$^2$ in bore holes having a diameter of 0.3 mm. It has to be taken into account though that reference to coating thicknesses of conductors lines for indicating throwing power of the metal is not generally acknowledged since on conductor lines which are possibly better shielded the layer of copper deposited is less thick as compared to copper on entirely plated areas so that mathematically a higher throwing value will be obtained.

Cathode current density utilized by way of example in EP 0 137 397 A2 is moreover relatively small so that more favorable values are obtained as a result thereof. Experience showed that, at a small current density, the obtained values for throwing power are generally good. On utilizing such a low current density however, the productiveness achieved for copper plating is very low. On selecting a higher average current density, throwing power on the bore hole walls decreases relative to that on the surface of the board so that coating thickness cannot be kept within a predetermined range of tolerance on using the baths of the art. In our appreciation, values of 60 to 70% are only achieved when the copolymers described in EP 0 137 397 A2 are added to the copper baths and when boards of 1.6 mm thick with bore holes with a diameter of 0.3 mm are copper plated at a cathode current density of 2.5 A/dm$^2$.

By contrast, when using the copper plating bath and the method according to the present invention, sufficiently high local current density is ascertained at the walls of very narrow bore holes even at a relatively high average current density of e.g. 4 A/dm$^2$, so that sufficient coating thickness may also be achieved there. In using average cathode current density of 2.5 A/dm$^2$ in the center of bore holes of 0.3 mm wide in boards of 1.6 mm thick (length of the hole: 1.6 mm), thickness of the deposited layer amounts to 80% referred to thickness of the overall area of the layer on the upper side of the board and not merely 60 to 70% as it is the case when using the additives described in EP 0 137 397 A2.

The conditions mentioned refer to the use of direct current. Alternatively, pulsed direct current (unipolar pulsed current) or a reverse pulse technique (bipolar pulsed current) may be used. For this purpose the electric voltage is varied in such a manner that a pulsed current is made to flow between the work piece and the at least one anode. By using pulsed current, coating thickness may be leveled even further.

b) The copper deposits are matt and show a very uniform, fine roughness. This roughness is necessary in order to provide, without additional pretreatment, a sufficient bond of organic coatings, of resists more specifically, that are applied onto the surfaces of the layers of copper. In the production of printed circuit boards, layers of copper are normally formed to produce conductors lines and other circuit structures such as bond pads and solder pads (lands). Upon completion of the circuit structures, a photostructural solder resist is usually applied onto the outer sides of the printed circuit boards. Even under thermal and chemical stress said resist must tightly adhere without any problem on the copper surfaces. The uniform roughness of the layers of copper constitute a particularly good base for photosensitive resists so that a strong bond may be formed between the solder resist and the copper surfaces.

c) The uniform level surface has still other advantages: Upon production of the circuit structures, the printed circuit boards are tested by means of optical methods. When optically tested, the normally very lustrous layers of copper may lead to errors in the recognition of structures. Matt coating surfaces, by contrast, permit to exclude faulty recognitions.

d) The layers of copper that may be produced with the copper plating bath and the method according to the invention show a very uniform, fine roughness, whereas the structure of known layers is in part of a coarser nature. When the printed circuit boards produced are used for purposes of high-frequency, this leads to more unfavorable electrical properties. Moreover, definition of the edges of the conductor lines is less accurate. The coarser surface structure of the layers deposited by means of known baths is due to the coarser size of the crystallites in the layer.

In comparing the polish of cross sections through layers produced with known baths and methods and through such created with the copper plating bath and the method according to the invention, it may be determined that the layers produced with known baths and methods include considerably larger crystallites than the layers created with the copper bath and the method according to the invention. This may be particularly well visualized when the cross sections are electropolished. The layers produced with known baths also show reduced breaking elongation on account of coarser structure of their crystallites.

e) Mechanical properties of the layers of copper deposited with the copper plating bath and the method according to the invention are very good: on one side, the layers obtained have a very high breaking elongation, on the other they have a high tensile strength. The values for breaking elongation obtained amount to 19% even at a cathode current density in excess of 2.5 A/dm$^2$. As a result thereof, the layers of copper will not crack during soldering of the printed circuit boards, even though the layers were produced at a high cathode current density. If breaking elongation and/or tensile strength were not high enough, the layer of copper could not follow thermal expansion of the resin material of the board brought about by abrupt rise in temperature, and it would crack more specifically at the transitions from the surface of the board to the walls of the bore holes. The layers produced from the copper plating bath and the method according to the invention withstand without any problem usual shock testing in which printed circuit boards are repeatedly placed to float on a solder bath having a temperature of 288° C. or, alternatively, on an oil bath of a temperature of 288° C., and are subsequently rapidly cooled down upon removing them from the heat source.

By contrast, breaking elongation of 6 to 20% is obtained with films of 50 μm thick when the baths described in EP 0 137 397 are utilized.

The polyglycerin compounds are produced according to known methods. Indications on the conditions of production are contained in the following publications for example: Cosmet. Sci. Technol. Ser., glycerines, page 106, 1991, Behrens, Mieth, Die Nahrung (Food), vol. 28, page 821, 1984, DE-A-25 27 701 and U.S. Pat. No. 3,945,894.

Glycerin, glycidol or epichlorohydrin may be used among others to produce the polygylcerin compounds. These are caused to polymerize under catalysis using alkaline substances at a temperature in a range of from 200 to 275° C. for example. Alternatively, polymerization may also be carried out in the presence of sulfuric acid or of boron trifluoride.

In a first variant of the production process, epichlorohydrin is hydrolyzed in the heat with caustic soda lye or with soda solution. Glycerins and oligomers of the glycerin are yielded thereby. Then, glycerin is separated by means of usual methods, raw polyglycerin is dehydrated and diglycerin is removed by fine distillation. Fractionating of residual matter yields tetraglycerin with small contents of higher oligomers/polymers. This polyglycerin constitutes a mixture A that contains at least 90% by weight of a polyglycerin compound with n=4 and a maximum of 10% by weight of polyglycerin compounds with n=3 and/or 5, the sum of proportions of the polyglycerin compounds in mixture A amounting to 100% by weight of mixture A. The polyglycerin compounds may be linear, branched and/or have cyclic moieties. The copper bath may for example contain such a polyglycerin mixture A of at least two polyglycerin compounds that each have one of general formulae I, II and III.

In a second variant of the production process, the reaction of the epichlorohydrin is carried out in the same manner as in the first variant. Then, glycerin is separated, raw polyglycerin dehydrated and diglycerin removed by means of fine distillation in the same way. In addition to tetraglycerin, this residue also contains other polyglycerins, more specifically triglycerin and higher condensed polyglycerin compounds. Mixture B hereby obtained contains at least 40% by weight of a polyglycerin compound with n=4, a maximum of 50% by weight of polyglycerin compounds with n=2, 3 and/or 5 and a maximum of 20% by weight of polyglycerin compounds with n=6, 7, 8 and/or 9, the sum of proportions of the polyglycerin compounds in mixture B amounting to 100% by weight of mixture B. The polyglycerins may be linear, branched and/or have cyclic moieties. The electrolytic copper plating bath may for example contain such a mixture B of at least two polyglycerin compounds that each have a respective one of general formula I, II and III.

The composition of the mixture of polyglycerin compounds may be varied by using various distillation conditions after the polyglycerin compound mixtures have been synthesized.

Further even other mixtures of polyglycerin compounds may be produced either by mixing any of mixtures of polyglycerin compounds, especially mixtures A and B, in an appropriate ratio or by isolating the individual polyglycerin compounds from mixtures A and/or B by means of conventional separation techniques to further composite any mixture. Thus a mixture C may be produced in which each polyglycerin compound has at least one of general formulae I, II and III, which may be linear, branched and/or have cyclic moieties. Mixture C contains from 30 to 35% by weight of a polyglycerin compound with n=4, from 50 to 60% by weight of polyglycerin compounds with n=2, 3 and/or 5 and 10 to 15% by weight of polyglycerin compounds with n≧6, the sum of proportions of the polyglycerin compounds in mixture C amounting to 100% by weight of mixture C.

Substitution of polyglycerin compounds may be obtained by general organic chemical reactions such as esterification and substitution of alcohols (Jerry March, Advanced Organic Reactions).

Advantageously, still higher homologues of the polyglycerin compounds having general formulae I, II or III may be employed, more specifically homologues with n>9, e.g. n=16.

In a preferred embodiment of the invention, the concentration of mixture A of the polyglycerin compounds in the electrolytic copper plating bath is in the range of from 0.3 g/l to 1.3 g/l. The concentration of mixture B of the polyglycerin compounds in the copper plating bath preferably is in the range of from 0.7 g/l to 2.6 g/l, more specifically in the range of from 0.8 to 2 g/l. The concentration of mixture C of the polyglycerin compounds in the copper bath ranges from 0.7 g/l to 2.6 g/l, more specifically in the range of from 0.8 to 2 g/l.

The polyglycerin compounds preferably have a molecular weight in the range of from 166 to 6000 g/mol, in a particularly preferred embodiment in the range of from 240 to 1600 g/mol.

The electrolytic copper plating bath according to the invention contains at least one copper salt and at least one acid. The copper salt is preferably selected from the group comprising cupric sulfate and copper fluoroborate. The acid is preferably selected from the group comprising sulfuric acid and fluoroboric acid. Moreover, the bath may contain chloride ions. An alkali salt, more specifically sodium chloride or potassium chloride, may for example be utilized. As a matter of course, hydrochloric acid may also be made use of. In principle, other compounds may be utilized instead of the aforementioned salts or the acid respectively.

Concentrations of the bath constituents is as follow:

| | |
|---|---|
| copper content: | 18 to 30 g/l, referred to $CuSO_4.5\ H_2O$<br>preferably 20 to 30 g/l |
| sulfuric acid, conc. | 180 to 250 g/l<br>preferably 220 to 250 g/l |
| chloride content: | 35 to 130 mg/l<br>preferably 50 to 70 mg/l. |

The electrolytic copper plating bath according to the invention may furthermore contain iron(II) compounds. Iron(II) salts, more specifically $FeSO_4$, may for example be included. Such salts are for example utilized to use insoluble anodes instead of soluble ones. In this case, iron(III) ions formed at the anodes serve to produce iron(II) ions by way of pieces of copper contained in a preferably separate vessel by causing the iron(III) ions to react with the pieces of copper to form iron(II) ions and copper(II) ions. In this way $Cu^{2+}$ is generated in the bath solution.

Furthermore, further bath constituents may be contained in the copper plating bath, such as for example basic leveling agents from the class selected from the group comprising polyethylene glycols and polypropylene glycols as well as of the block copolymers thereof. The bath may also include throwing additives and grain refiners such as compounds of the class selected from the group comprising meriquinoid compounds, pyridines and pyridinium sulfobetaines.

Cathode current density may be chosen to be higher than in known methods, wherein coating thickness may be kept within a narrow range of tolerance (80 to 100%) at all places of a printed circuit board. Usually, the layers of copper obtained are extensively uniform when the cathode current density is chosen to range from 0.5 to 4 A/dm$^2$. When the values are set within this range, layers may also be obtained that are uniformly matt. When cathode current density does not exceed 0.5 A/dm$^2$, the deposits have a silk-matt finish. A current density ranging from 1 to 4 A/dm$^2$ yields very good results. Typically, excellent results are obtained at a cathode current density of about 2.5 A/dm$^2$.

During operation, temperature of the copper bath is preferably adjusted to a value in the range of from 20 to 40° C., preferably in the range of from 25 to 35° C.

The electrolytic copper plating bath may be agitated by a strong flow and possibly by blowing clean air into the bath in such a manner that the surface of the bath is caused to strongly move. As a result thereof, transport of the substances in proximity to the work piece and the anodes is maximized so that higher current densities are made possible. To move the work piece also improves transport of the substances at the respective surfaces. Increased convection and movement of the electrodes permit to achieve constant deposition with controlled diffusion. The substrates may be moved in horizontal, vertical direction and/or by vibration. To combine it with blowing of air into the copper plating bath is particularly efficient.

Copper used up in the deposition process may be electrochemically complemented by way of copper anodes. The copper used for soluble anodes may contain 0.02 to 0.067 percent by weight phosphorus. The anodes can be directly suspended in the electrolyte or be used in the form of balls or pieces and be filled into titanium baskets located in the bath for this purpose. In principle, insoluble anodes may also be utilized in the copper bath, the external geometrical shape thereof remaining unaltered during the process of deposition. Said anodes may for example consist of titanium or lead, but may be coated with metal catalysts like platinum for example, in order to avoid a high anode overvoltage.

In the customarily employed coating installations, the printed circuit boards are normally maintained in vertical or horizontal position during the process of deposition. Those coating installations are advantageous in which the printed circuit boards are conveyed through the line in horizontal direction, being copper plated in the process. DE 32 36 545 C2, DE 36 24 481 C2 and EP 0 254 962 A1, herein incorporated for reference, for example suggest constructive solutions to electrically contact the printed circuit boards and to concurrently convey them through the installation.

The following examples serve to explain the invention:

EXAMPLE 1

A mixture C of polyglycerin compounds comprising 10.2% diglycerin, 12.7% triglycerin, 32.1% tetraglycerin, 31.4% pentaglycerin, 8.9% hexaglycerin, 4.7% heptaglycerin and lower amounts of higher homologues was produced according to the second variant of the production process to form a mixture C of polyglycerin compounds. The indications in [%] are relative values that together yield 100% for the polyglycerin compounds with n=2–7. The values are related to the weight per cent in the mixture.

Utilizing the afore-mentioned mixture C of polyglycerin compounds, a copper bath with the following composition was produced by dissolving the constituents in water:

| | |
|---|---|
| $CuSO_4 \cdot 5\ H_2O$ | 80 g (≙ 20 g $Cu^{2+}$) |
| Sulfuric acid, conc. | 240 g |
| NaCl | 52 mg |
| Mixture C of the polyglycerin compounds in 1 l water. | 1 g |

Within 75 minutes, a layer of copper was deposited from the bath described herein above at an average cathode current density of 2.5 A/dm$^2$ at a bath temperature of 25° C. onto a copper carrier that had previously been electroless nickel plated. A copper anode was utilized. The layer obtained was uniformly matt and provided a uniform thickness of 33 μm over the entire carrier.

FIG. 1 represents a map of the coating surface that was obtained by means of a scanning electron microscope at a magnification of ×1000. Well formed crystallites may be surveyed on the map.

Thereafter, the layer of copper could be readily peeled off the nickel plated carrier, a film of copper being thus obtained. The mechanical properties of the film of copper could easily be determined as a result thereof. The film had a breaking elongation of 19% and a tensile strength of 39 kN/cm$^2$.

Then, printed circuit board material with a thickness of 1.6 mm and with bore holes having a diameter of 0.3 mm was copper plated with the same bath at an average current density of 2.5 A/dm$^2$.

Figure 2:
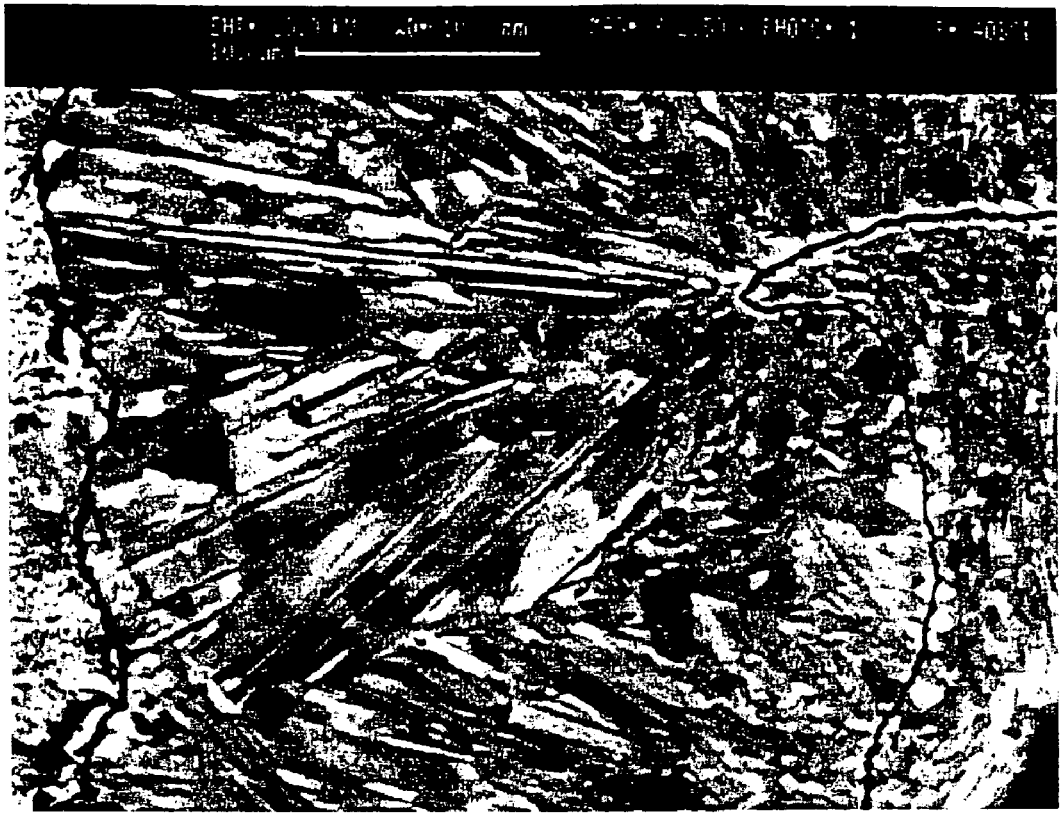
FIG. 2 is an electron micrograph showing a map of an electropolished cross section of a transition of the layer of copper from outer side of the material to the wall of the bore hole obtained by means of a scanning electron microscope at a magnification of x2500.

FIG. 2 represents an image formed by a microscope at a magnification ×2500 upon production of an electropolished cross section of a transition of the layer of copper from the outer side of the material to the wall of the bore hole. Well formed crystallites can be surveyed from the image.

Polished cross sections were produced to determine the coating thickness distribution in the bore holes by measuring coating thickness in the center of the bore holes and on the outer side of the material. For this purpose, the thickness in the center of each bore hole was related to the thickness at the outer side of the material by measuring the ratio of the respective coating thicknesses. According to this method, throwing power was determined to amount to 80%.

To determine the mechanical properties of the layer of copper on the printed circuit board material, copper plated pieces of board were examined by means of a solder shock test. For this purpose, the pieces of board were placed for 10 sec on a tin/lead solder bath having a temperature of 288° C. and were cooled down subsequently. This cycle was performed ten times.

Then, the integrity of the layer of copper was examined by making polished cross sections through the layer of copper in the bore holes. No cracks were ascertained in the layer of copper at the transition from the outer sides to the bore hole walls at the entrance of the bore holes. No observations were made that the transitions from the layer of copper in the bore holes to interior layers of copper cut by the bore holes were torn.

EXAMPLE 2

A mixture of polyglycerin compounds was prepared in accordance with the procedure as outlined above to give mixture A. This mixture contained at least 90% by weight of tetraglycerin and a maximum of 10% by weight of triglycerin and/or pentaglycerin. This mixture was applied in an electrolytic copper plating bath having the following composition in water:

| | |
|---|---|
| $CuSO_4.5\ H_2O$ | 72 g (Δ 18 g $Cu^{2+}$) |
| Sulfuric acid, conc. | 180 g |
| $Cl^-$ | 50 mg |
| Mixture A of the polyglycerin compounds in 1 l water. | 0.1 to 1.3 g |

The amount of polyglycerin compounds in the copper plating bath was varied within the range given above.

The test was performed in a 10 l bath first and thereafter in a 110 l bath. Temperature of the copper bath ranged from 20 to 24° C. Cathodic current density was set at 2.5 A/dm$^2$.

Printed circuit board material having a thickness of 1.6 mm was then treated with the copper bath. The board material was provided with through holes having a diameter of 0.3 mm (aspect ratio: 5.3:1).

Prior to testing visual appearance, soldering performance and throwing power of the copper plating layers obtained, board material was treated in the bath as long as until 20 Ampere·hours charge has been delivered to each liter of the bath.

Upon copper plating evenly matt copper layers were formed the layers being light rose to salmon-coloured and exhibiting no pits. Solder shock testing revealed that the copper layers passed IPC 6 standard. Throwing power was tested as described in Example 1. It proved to be 76±5%.

COMPARATIVE EXAMPLE

A copper bath with the following composition was prepared:

| | |
|---|---|
| copper sulfate | 75 g |
| sulfuric acid, conc. | 200 g |
| NaCl | 55 mg |
| commercially available additive for matt copper bath in 1 l of water. | 6 ml |

From this bath, a layer of copper was deposited on a printed circuit board material of 1.6 mm thick having bore holes with a diameter of 0.3 mm at an average current density of 2.5 A/dm$^2$ with a bath temperature of 26° C. After 30 min, the thickness of the copper deposits amounted to 16 μm on the outer side of the material and to 10 μm in the bore holes. Copper anodes were used.

Coating thickness distribution in the bore holes was determined by measuring coating thickness in the center of the bore holes and on the outer side of the material in the same way as in the afore-mentioned example. According to this method, throwing power amounted to 60 to 70%.

The invention claimed is:

1. An electrolytic copper plating bath for depositing a matt layer of copper comprising at least one copper salt, at least one acid, and at least one polyglycerin compound having at least one of the general formulae I, II or III:

(I)

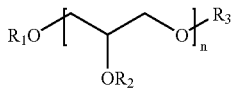

wherein n is an integer>1 and $R_1$, $R_2$, $R_3$ are identical or different and are selected from the group consisting of H, alkyl, acyl, phenyl and benzyl; or (II)

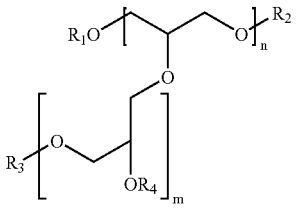

wherein n is an integer>0, m is an integer>0 and $R_1$, $R_2$, $R_3$, $R_4$ are identical or different and are selected from the group consisting of H, alkyl, acyl, phenyl and benzyl; or (III)

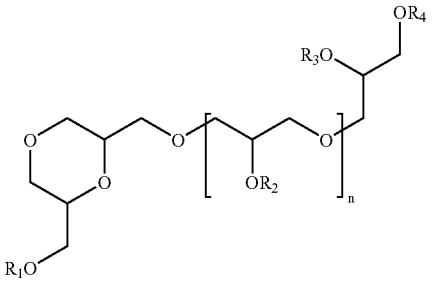

wherein n is an integer>0, $R_1$, $R_2$, $R_3$, $R_4$ are identical or different and are selected from the group consisting of H, alkyl, acyl, phenyl and benzyl.

2. The electrolytic copper plating bath of claim 1, wherein the at least one polyglycerin compound is selected from the group consisting of poly(1,2,3 -propanetriol), poly(2,3-epoxy-1-propanol) and derivatives thereof.

3. The electrolytic copper plating bath of claim 1, wherein the alkyl is linear or branched $C_1$–$C_{18}$ alkyl and/or the acyl is $R_5$—CO, wherein $R_5$ is linear or branched $C_1$–$C_{18}$ alkyl, phenyl or benzyl.

4. The electrolytic copper plating bath of claim 1, wherein the copper bath comprises a mixture A of at least two polyglycerin compounds, each polyglycerin compound having at least one of the general formulae I, II or III, said mixture A containing at least 90% by weight of a polyglycerin compound with n=4 and a maximum of 10% by weight of polyglycerin compounds with n=3 and/or 5, the sum of proportions of the polyglycerin compounds in mixture A amounting to 100% by weight of mixture A.

5. The electrolytic copper plating bath of claim 4, wherein the concentration of mixture A of the polyglycerin compounds in the copper bath ranges from 0.3 g/l to 1.3 g/l.

6. The electrolytic copper plating bath of claim 1, wherein the copper bath comprises a mixture B of at least two polyglycerin compounds, each polyglycerin compound having at least one of the general formulae I, II or III, said mixture B containing at least 40% by weight of a polyglycerin compound with n=4, a maximum of 50% by weight of polyglycerin compounds with n=2, 3 and/or 5 and a maximum of 20% by weight of polyglycerin compounds with n=6, 7, 8 and/or 9, the sum of proportions of the polyglycerin compounds in mixture B amounting to 100% by weight of mixture B.

7. The electrolytic copper plating bath of claim 6, wherein the concentration of mixture B of the polyglycerin compounds in the copper bath ranges from 0.7 g/l to 2.6 g/l.

8. The electrolytic copper plating bath of claim 1, wherein the copper bath comprises a mixture C of at least two polyglycerin compounds, each polyglycerin compound having at least one of the general formulae I, II or III, said mixture C containing from 30 to 35% by weight of a polyglycerin compound with n=4, from 50 to 60% by weight of polyglycerin compounds with n=2, 3 and/or 5 and 10 to 15% by weight of polyglycerin compounds with n≧6, the sum of proportions of the polyglycerin compounds in mixture C amounting to 100% by weight of mixture C.

9. The electrolytic copper plating bath of claim 8, wherein the concentration of mixture C of the polyglycerin compounds in the copper bath ranges from 0.7 g/l to 2.6 g/l.

10. The electrolytic copper plating bath of claim 1, wherein the polyglycerin compounds have a molecular weight ranging from 166 to 6000 g/mol.

11. A method of electrodepositing a matt layer of copper on the surface of a work piece, including the following method steps:

a. providing the work piece, at least one anode and an electrolytic copper plating bath;

b. contacting the surface of the work piece and the at least one anode, respectively, with the copper bath;

c. applying an electric voltage between the surface of the work piece and the at least one anode in such a manner that cathodic polarity is imposed upon the work piece relative to the at least one anode;

wherein the copper bath contains at least one polyglycerin compound having at least one of the general formulae I, II or III:

(I)

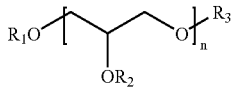

wherein n is an integer>1 and $R_1$, $R_2$, $R_3$ are identical or different and are selected from the group consisting of H, alkyl, acyl, phenyl and benzyl; or (II)

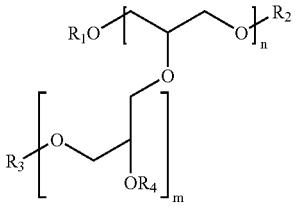

wherein n is an integer>0, m is an integer>0 and $R_1$, $R_2$, $R_3$, $R_4$ are identical or different and are selected from the group consisting of H, alkyl, acyl, phenyl and benzyl; or (III)

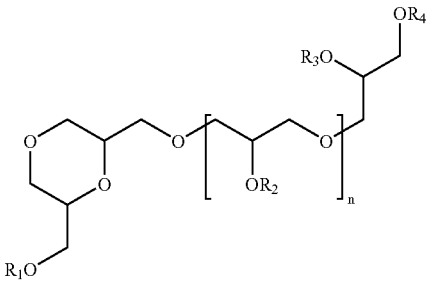

wherein n is an integer>0, $R_1$, $R_2$, $R_3$, $R_4$ are identical or different and are selected from the group consisting of H, alkyl, acyl, phenyl and benzyl.

12. The method of claim 11, wherein the alkyl is linear or branched $C_1$–$C_{18}$ alkyl and/or the acyl is $R_5$—CO, wherein $R_5$ is linear or branched $C_1$–$C_{18}$ alkyl, phenyl or benzyl.

13. The method of claim 11, wherein the copper bath contains a mixture A of at least two polyglycerin compounds, each polyglycerin compound having at least one of the general formulae I, II or III, said mixture A containing at least 90% by weight of a polyglycerin compound with n=4 and a maximum of 10% by weight of polyglycerin compounds with n=3 and/or 5, the sum of proportions of the polyglycerin compounds in mixture A amounting to 100% by weight of mixture A.

14. The method of claim 13, wherein the concentration of mixture A of the polyglycerin compounds in the copper bath ranges from 0.3 g/l to 1.3 g/l.

15. The method of claim 11, wherein the copper bath contains a mixture B of at least two polyglycerin compounds, each polyglycerin compound having at least one of the general formulae I, II or III, said mixture B containing at least 40% by weight of a polyglycerin compound with n=4, a maximum of 50% by weight of polyglycerin compounds with n=2, 3 and/or 5 and a maximum of 20% by weight of polyglycerin compounds with n=6, 7, 8 and/or 9, the sum of proportions of the polyglycerin compounds in mixture B amounting to 100% by weight of mixture B.

16. The method of claim 15, wherein the concentration of mixture B of the polyglycerin compounds in the copper bath ranges from 0.7 g/l to 2.6 g/l.

17. The method of claim 11, wherein the copper bath contains a mixture C of at least two polyglycerin compounds, each polyglycerin compound having at least one of the general formulae I, II or III, said mixture C containing from 30 to 35% by weight of a polyglycerin compound with n=4, from 50 to 60% by weight of polyglycerin compounds with n=2, 3, and/or 5 and 10 to 15% by weight of polyglycerin compounds with n≧6, the sum of proportions of the polyglycerin compounds in mixture C amounting to 100% by weight of mixture C.

18. The method of claim 17, wherein the concentration of mixture C of the polyglycerin compounds in the copper bath ranges from 0.7 g/l to 2.6 g/l.

19. The method of claim 11, wherein the polyglycerin compounds have a molecular weight ranging from 166 to 6000 g/mol.

20. The method of claim 11, wherein the electric voltage is varied in such a manner that a pulsed current is made to flow between the work piece and the at least one anode.

21. The method of claim 11, wherein the method further includes forming an organic coating on the matt layer of copper on the surface of the work piece.

22. The method of claim 21, wherein the organic coating is a photoresist layer.

23. An electrolytic copper plating bath for depositing a matt layer of copper comprising at least one copper salt, at least one acid, and at least one polyglycerin compound selected from the group consisting of poly(1,2,3-propanetriol), poly(2,3-epoxy-1-propanol) and derivatives thereof.

24. The electrolytic copper plating bath of claim 23, wherein the polyglycerin compounds have a molecular weight ranging from 166 to 6000 g/mol.

25. A method of electrodepositing a matt layer of copper on the surface of a work piece, including the following method steps:

a. providing the work piece, at least one anode and an electrolytic copper plating bath;

b. contacting the surface of the work piece and the at least one anode, respectively, with the copper bath;

c. applying an electric voltage between the surface of the work piece and the at least one anode in such a manner that cathodic polarity is imposed upon the work piece relative to the at least one anode;

wherein the copper bath contains at least one polyglycerin compound selected from the group consisting of poly (1,2,3-propanetriol), poly(2,3-epoxy-1propanol) and derivatives thereof.

26. The method of claim 25, wherein the polyglycerin compounds have a molecular weight ranging from 166 to 6000 g/mol.

27. The method of claim 25, wherein the electric voltage is varied in such a manner that a pulsed current is made to flow between the work piece and the at least one anode.

28. The method of claim 25, wherein the method further includes forming an organic coating on the matt layer of copper on the surface of the work piece.

29. The method of claim 25, wherein the organic coating is a photoresist layer.

* * * * *